US008251841B2

(12) United States Patent
Ishii

(10) Patent No.: US 8,251,841 B2
(45) Date of Patent: Aug. 28, 2012

(54) METHOD AND APPARATUS FOR ANALYZING A GOLF SWING

(75) Inventor: Hideyuki Ishii, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 144 days.

(21) Appl. No.: 12/617,148

(22) Filed: Nov. 12, 2009

(65) Prior Publication Data

US 2011/0111872 A1 May 12, 2011

(51) Int. Cl.
*A63B 69/36* (2006.01)

(52) U.S. Cl. ..... 473/409; 473/219; 473/278

(58) Field of Classification Search ..... 473/257, 473/258, 261, 262, 263–266, 278, 279, 409
See application file for complete search history.

(56) References Cited

U.S. PATENT DOCUMENTS

| | | | | |
|---|---|---|---|---|
| 3,717,349 | A * | 2/1973 | Bohnen | 473/262 |
| 4,130,283 | A * | 12/1978 | Lindquist | 473/262 |
| 4,451,043 | A * | 5/1984 | Ogawa et al. | 473/225 |
| 4,955,611 | A * | 9/1990 | Moller | 473/262 |
| 5,803,826 | A * | 9/1998 | Perrine | 473/278 |
| 5,967,906 | A | 10/1999 | Horiuchi et al. | |
| 6,155,931 | A * | 12/2000 | Perrine | 473/278 |
| 6,244,973 | B1 | 6/2001 | Eichelberger | |
| 6,547,681 | B1 * | 4/2003 | Wood et al. | 473/405 |
| 6,794,447 | B1 | 9/2004 | Kim et al. | |
| 6,913,544 | B2 * | 7/2005 | Tiffin | 473/278 |
| 7,384,352 | B2 | 6/2008 | Ohama et al. | |
| 7,396,301 | B2 | 7/2008 | Ohama et al. | |
| 7,410,430 | B2 | 8/2008 | Isogawa et al. | |
| 2006/0128493 | A1 * | 6/2006 | Snopkowski | 473/278 |
| 2007/0042830 | A1 | 2/2007 | Zimmerman | |
| 2007/0298896 | A1 | 12/2007 | Nusbaum et al. | |
| 2008/0039236 | A1 | 2/2008 | Isogawa et al. | |
| 2009/0054175 | A1 | 2/2009 | Isogawa et al. | |
| 2009/0054176 | A1 | 2/2009 | Isogawa et al. | |
| 2009/0082137 | A1 | 3/2009 | Okabe | |

FOREIGN PATENT DOCUMENTS

| | | |
|---|---|---|
| JP | 2006075210 | 3/2006 |
| WO | 2004076008 | 9/2004 |

OTHER PUBLICATIONS

Extended European Search Report dated Mar. 18, 2011 in European Patent Application No. 10190769.9-2318.
US 5,766,097, 07/1998, Horiuchi et al. (withdrawn).

* cited by examiner

*Primary Examiner* — Nini Legesse
(74) *Attorney, Agent, or Firm* — Plumsea Law Group, LLC

(57) ABSTRACT

This disclosure relates to a method for analyzing a golf swing, and an associated apparatus for use in the method. More specifically, this disclosure relates generally to a method of analyzing a golf swing by impacting a deformable medium with a golf club head. In the method, a club head impacts the deformable medium, causing the deformable medium to change shape. The change in shape may then be correlated to the value of a swing profile characteristic. Alternatively, the deformable medium may include a sensor, such that the sensor senses a measurement that is correlated to a value of a swing profile characteristic. Also disclosed are a deformable medium and a kit for use in the method.

10 Claims, 17 Drawing Sheets

| (CONSTANT SECTION THICKNESS) | CLUB HEAD SPEED | | |
|---|---|---|---|
| CLUB | FIRST SECTION | SECOND SECTION | THIRD SECTION |
| CLUB HEAD WEIGHT ~ 180 GRAMS | MEDIUM | HIGH | HIGHEST |
| CLUB HEAD WEIGHT ~ 200 GRAMS | SLOW | MEDIUM | HIGH |
| CLUB HEAD WEIGHT ~ 220 GRAMS | SLOWEST | SLOW | MEDIUM |

FIG. 19

METHOD AND APPARATUS FOR ANALYZING A GOLF SWING

BACKGROUND

The present disclosure relates to a method for analyzing a golf swing, and an associated apparatus for use in the method. More specifically, the present disclosure relates generally to a method of analyzing a golf swing by impacting a deformable medium with a golf club head.

The game of golf requires that the golfer exhibit fine control over the mechanics of his or her swing. Small differences in a golfer's swing can dramatically affect how the golf ball is hit and subsequently plays. Both amateur and professional golfers spend sizeable amounts of time developing the muscle memory and fine motor skills necessary to improve their game.

A variety of devices are known in the art that measure a golf swing. Such devices enable a golfer to measure various aspects of his or her swing, so that the golfer may critique and improve these aspects. Such devices generally require that a golfer take swings at a ball while being monitored by launch monitors, video devices and other measuring devices. The measurements generally taken include the club head speed, ball speed, launch angle, attack angle, backspin, sidespin and total distance, among others.

Such devices may also be used to gather swing data for ball fitting purpose. Ball fitting systems are discussed in U.S. Patent Application Publication No. 2011/0009215, which was filed as U.S. patent application ser. No. 12/498,364 on Jul. 7, 2009, and is entitled "Method and System for Ball Fitting Analysis" the disclosure of which is hereby incorporated in its entirety.

However, such devices suffer from several deficiencies. Foremost among these is cost. Some types of launch monitors generally use radar technology in conjunction with the Doppler effect to measure the speed and position of the golf club and ball. These launch monitors must be capable of emitting the precise type of radar necessary, as well as analyzing the shift in frequency due to the Doppler effect, in order to provide useful information to the golfer. The launch monitors therefore tend to be expensive, and can be especially cost prohibitive for amateur golfers. Similarly, video monitors generally require at least one video camera and video analysis software. Some video monitors use multiple video cameras, in order to view the golfers swing from multiple angles. However, this equipment is, again, expensive.

Accordingly, amateur golfers would prefer to be able to measure various aspects of their swings in an accurate and cost effective manner.

There is a need in the art for a system and method that addresses the shortcomings of the prior art discussed above.

SUMMARY

In one aspect, this disclosure provides a method for analyzing a golf swing of a golfer swinging a golf club, the method comprising the steps of providing a deformable medium having a first configuration; positioning the deformable medium in a path of the golf swing, such that at least a portion of a club head of the golf club will impact the deformable medium during the golf swing and cause the deformable medium to assume a second configuration, the second configuration being different from the first configuration; obtaining a measurement that characterizes a change in shape between the first configuration and the second configuration; and correlating the measurement to a value of at least one swing profile characteristic.

In another aspect, this disclosure provides a method as mentioned, wherein a deformable medium includes at least one sensor.

This disclosure also provides a deformable medium for gathering golf club impact information, the medium having a predetermined compressive strength such that the medium will undergo plastic deformation when impacted by a golf club so as to result in a deformation, the medium comprising a series of at least two contiguous sections of deformable material, wherein each section is marked such that each section can be visibly distinguished from the others, each section has a predetermined thickness, and the sections are configured such that a value of a golf swing profile characteristic can be determined from the deformation based on the predetermined thickness of each segment deformed and the number of segments deformed.

Finally, this disclosure provides a kit containing the deformable medium as mentioned, and a table displaying at least one relationship between the predetermined thickness of each segment deformed, the number of segments deformed and the value of the golf swing profile characteristic.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 19 shows a representative embodiment of a table that displays a relationship between deformation of the deformable medium and a swing profile characteristic, based on a related attribute of the golf club.

DETAILED DESCRIPTION

A method for analyzing a golf swing includes the use of a deformable medium, where a golf club impacts the deformable medium during a golf swing such that the deformable medium changes configuration. The change in configuration may then be correlated to the value of a swing profile characteristic.

Figure 1:
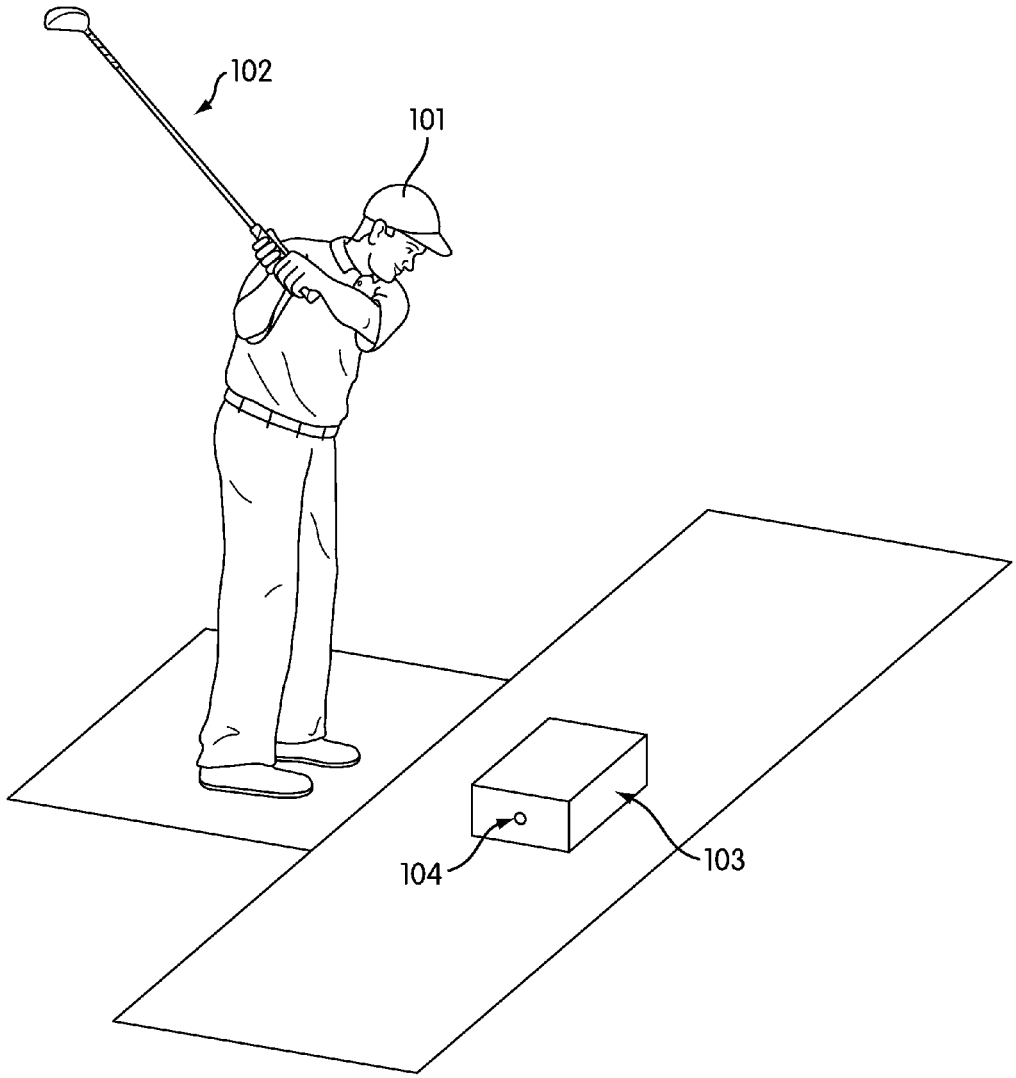
FIG. 1 shows a golfer about to swing a golf club into an embodiment of a deformable medium.

A golfer 101 may desire to gain information about the swing profile characteristics of his or her golf swing. As shown in FIG. 1, the golfer 101 may swing a golf club 102 at a deformable medium 103. The golf club 102 as shown in FIG. 1, and throughout the figures, is a driver, however the golf club 102 may be any type of golf club, such as an iron or a putter, as desired by the golfer 101.

The golfer may aim at a target 104 on the deformable medium 103. The target 104 merely provides a frame of reference for the golfer 101, such that the golfer 101 may aim at the target 104 just as he or she would aim at a golf ball on a tee.

Figure 2:
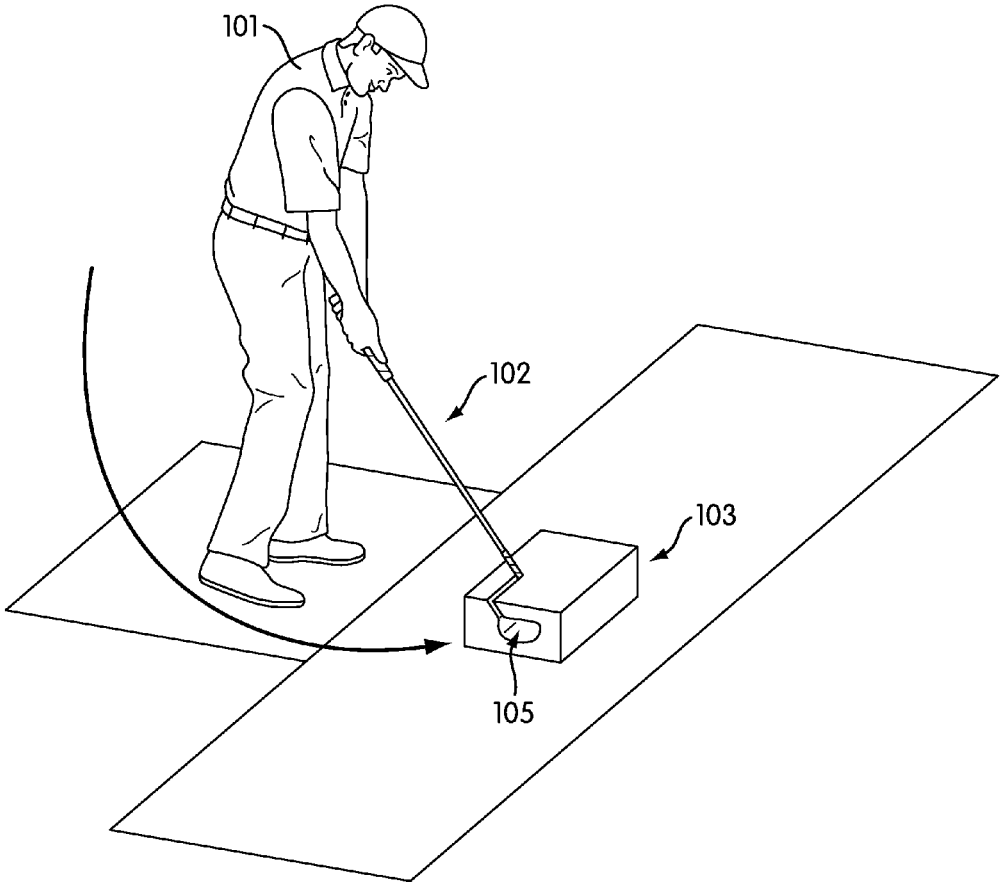
FIG. 2 shows the golfer after the golf club has impacted the deformable medium of FIG. 1.

The deformable medium 103 is provided in the path of a golf swing, such that the golf club 102 impacts the deformable medium 103 as the golfer 101 completes his or her golf swing. FIG. 2 shows the impact between the golf club 102 and the deformable medium 103. As a result of the impact, the deformable medium 103 changes shape. Specifically, the deformable medium 103 changes from a first configuration as shown in FIG. 1 to a second configuration as shown in FIG. 2, as indicated at 105. The second configuration is different from the first configuration.

Figure 3:
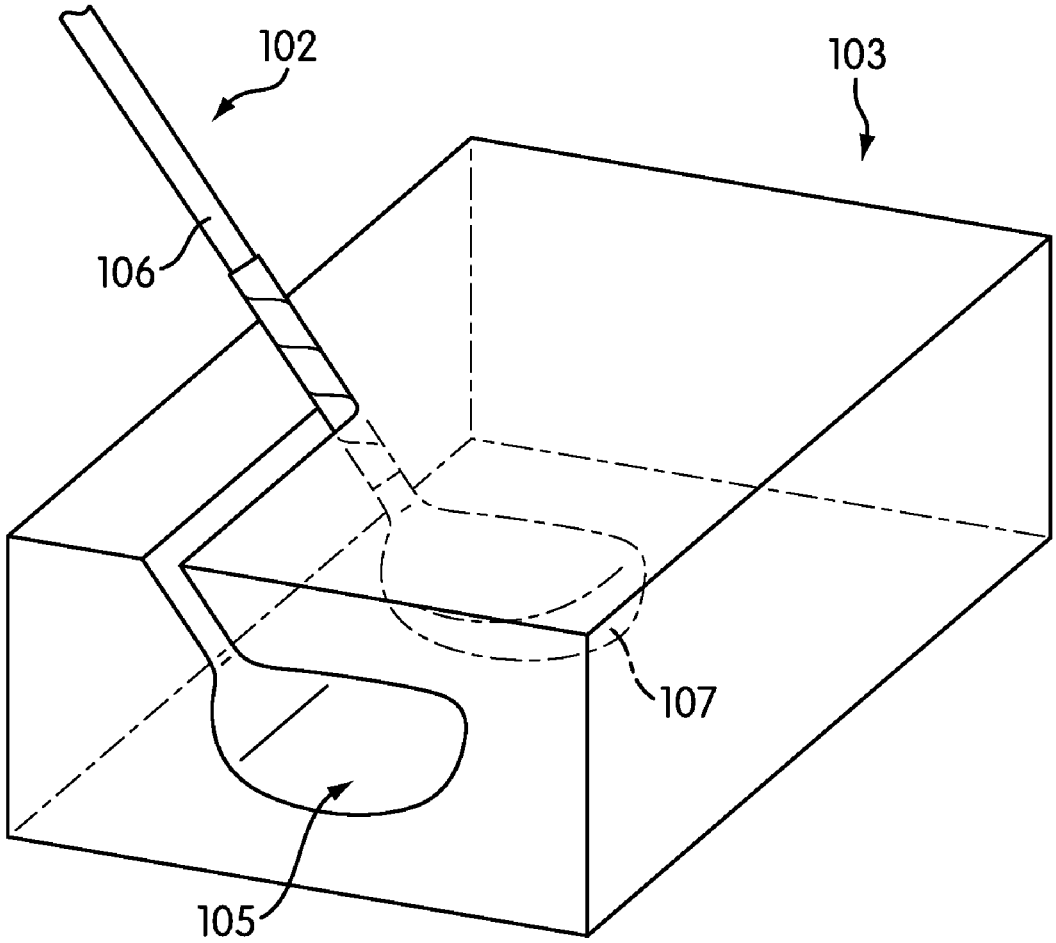
FIG. 3 shows a close-up view of the deformable medium of FIG. 1 after impact by the golf club.
Figure 4:
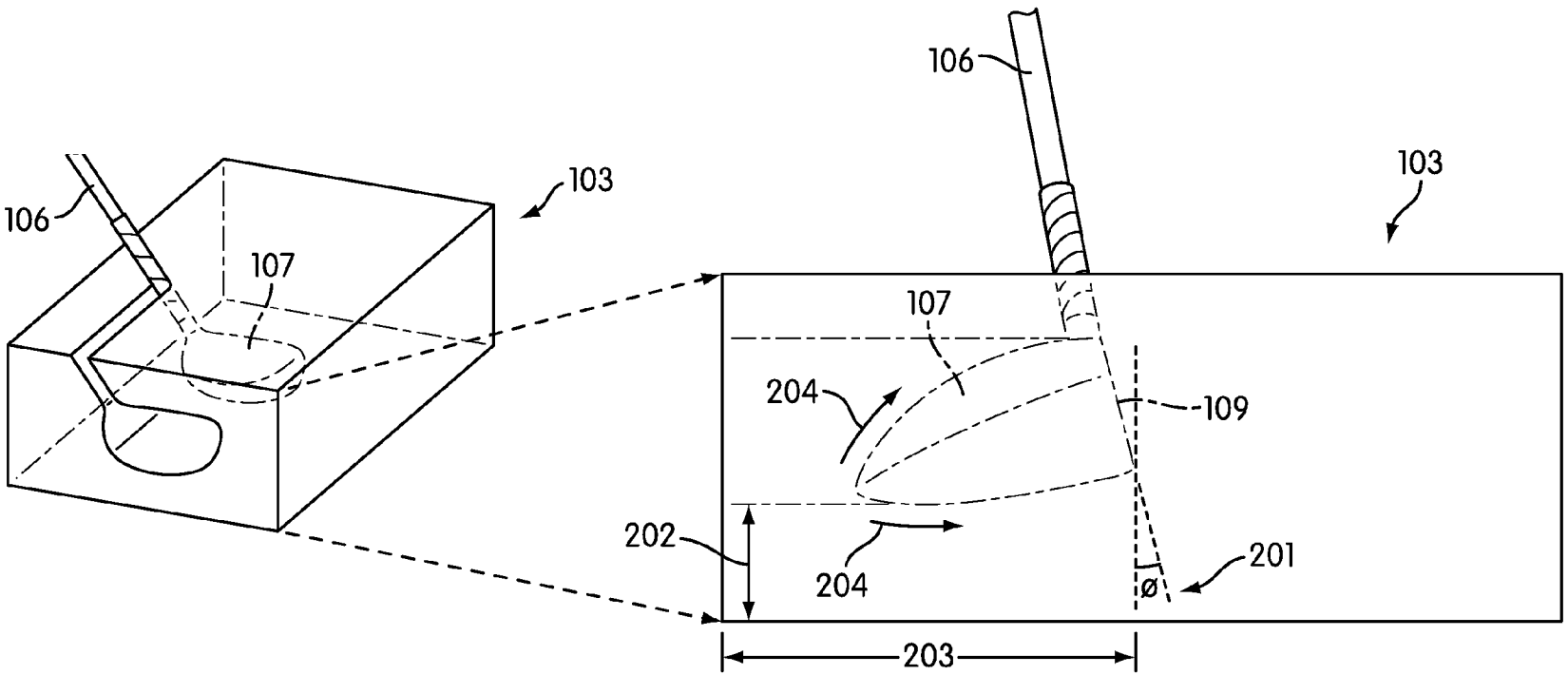
FIG. 4 shows a side view of the deformable medium of FIG. 1 after impact, and several various positions and angles of the golf club in the deformable medium.

The impact between the golf club 102 and the deformable medium 103 is shown in further detail in FIG. 3. Specifically, at least a portion of the club head 107 impacts the deformable medium 103. In some embodiments, as shown in FIG. 3 and FIG. 4, the deformable medium is adjacent to a perimeter of the club head on three sides upon impact. A portion of the club shaft 106 may also impact the deformable medium. However, the club shaft 106 generally need not impact the deformable medium 103 in order to determine the value of a swing profile characteristic.

Generally, the swing profile characteristic that may be determined by the method may include at least one of club head speed, angle of attack, angle by which a club face is open/closed, vertical angle of a club face, and the vertical position of club face. For example, FIG. 4 shows several measurements of the second configuration 105 of the deformable medium 103 that can be correlated to the value of at least one swing profile characteristic. FIG. 4 shows a side sectional view of the deformable medium 103 after impact by the golf club head 107.

First, the second configuration 105 of the deformable medium 103 can correlate to the club head speed. As is generally known in the art, the club head speed is the speed at which a club head is moving at the moment the club head impacts a target (such as a golf ball). Club head speed is important to a golfer's swing, as the club head speed relates to the power and distance achieved during a drive. The club head speed may be determined based on the distance 203 that the club head 107 travels into the deformable medium 103.

Specifically, the deformable medium may have a known predetermined elasticity and a known predetermined compressive strength. The compressive strength will generally be of greater importance to determining club head speed than the elasticity in embodiments such as are shown in FIGS. 1-15, wherein the deformable medium permanently assumes the second position. As is generally known in the art, the compressive strength of a material is the point on the stress-strain curve where elastic deformation ends, and plastic deformation begins. Compressive strength is also sometimes referred to as "crush strength", "yield strength" under compression, "plastic yield strength" under compression. The compressive strength should generally be within a range such that the deformable medium 103 absorbs the impact of the club head, for a range of usual club head speeds and a range of usual club head weights.

Furthermore, one or more related attribute of the club head may also be used to determine the value of a swing profile characteristic. A related attribute of the club head may include, for example, the weight (i.e., mass) of the club head 107, the surface area of the face 109 of the club head, or the length of the club shaft 106. Therefore, the value of the club head speed may be determined from the distance 203, the predetermined compressive strength, as well as any necessary related attributes of the golf club.

A swing profile characteristic, closely related to the club head speed, which may be determined by the present method is the force applied by a golfer 101 to the club 102 during the swing. Specifically, the force applied by a golfer may be determined from the distance 203 and the length of the club shaft 106 by first determining the club head speed at impact (as discussed above). Then, the change from potential energy to kinetic energy as the club head 107 falls from the top of the swing to the impact location along the path of the swing is calculated. The path of the swing is directly related to the length of the club shaft 107, because a longer club shaft will create a wider "arc" along which the club head travels. The difference between the expected club head speed based on this change from potential to kinetic energy, and the actual club head speed, therefore relates to the force applied by the golfer 101 to the club 102 during the swing.

FIG. 4 also shows how other swing profile characteristics may be determined. The angle of attack represents the angle of the club head's path as it travels toward, and then makes contact with, the golf ball. As a reference point, a zero angle of attack generally means that the club head is traveling level with the ground at impact. This is sometimes called a sweeping angle of attack. A golfer's swing is much more likely to produce a positive angle of attack, that is, traveling below the ball and moving up through impact, or a negative angle of attack, that is, coming down at the golf ball and moving below the ball after impact. Therefore a "flatter" swing will generally improve both distance and accuracy with a driver. A shallow angle of attack results in a more solidly hit ball with less spin producing a longer and straighter shot.

The angle of attack may be determined from the angle 201 as measured in the second configuration 105 of the deformable medium 103. When the golfer 101 swings the club head 107 into the deformable medium 103, the angle of attack may vary as shown by the arrows 204. The angle 201 may also depend on the loft angle of the club head. As is generally known in golf, the loft angle of a club head is the angle of the clubface 109 in relation to a vertical plane that is perpendicular to the ground. Therefore, a value of the angle of attack may be determined from the measurement of angle 201 and the related attribute of the golf club, such as the loft angle. A standard length of the club shaft 106, such as 45 inches may be used.

Next, the method may also be used to determine the vertical position of a club face 109. Specifically, the distance 202 as shown in FIG. 4 can be used as a measure of the vertical position of the club face 209. A golfer may desire to know the vertical position of his or her club face, because proper alignment of the club head's center of gravity with the target golf ball will help ensure good distance and control.

Figure 5:
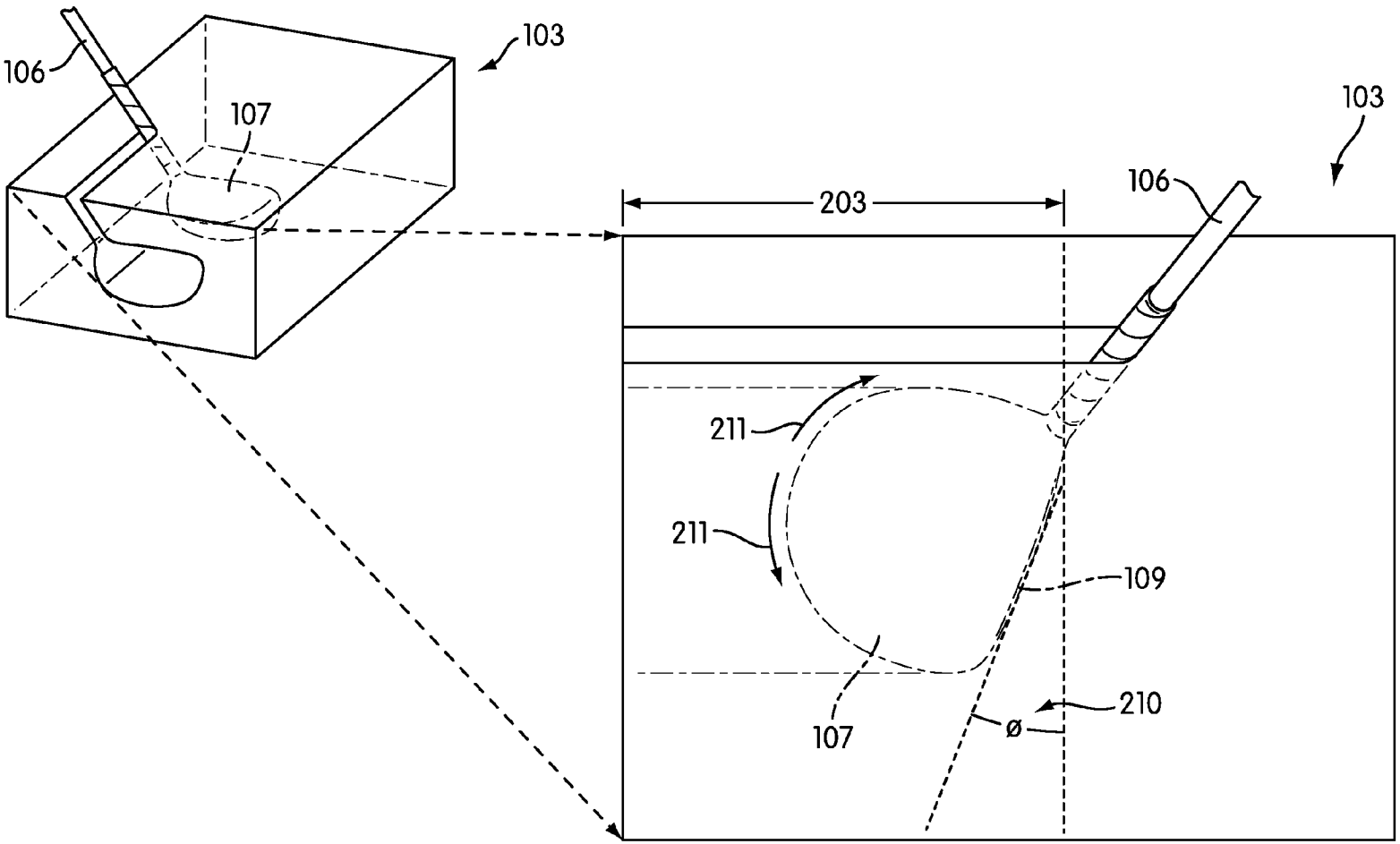
FIG. 5 shows a top view of the deformable medium of FIG. 1 after impact, and several various positions and angles of the golf club in the deformable medium.

As shown in FIG. 5, the change 105 in configuration of the deformable medium 103 may also be used to determine the value of an angle by which a club face 109 is open or closed. FIG. 5 is a top sectional view of the deformable medium 103. Specifically, angle 210 is the degree by which the club face 109 is open or closed. As is used in the art of golf, a "open" club face means that the club face 109 faces away from the golfer 101 at the point during the golf swing when the club head 107 hits a target (such as a golf ball). The angle 210 as shown in FIG. 5 is an "open" club face. In contrast, a "closed" club face faces toward the golfer 101. The value of the angle by which a club face is open or closed may vary as the club head moves as shown by arrows 211. The angle by which a club face 109 is open or closed will affect whether a ball will hook or slice.

Figure 6:
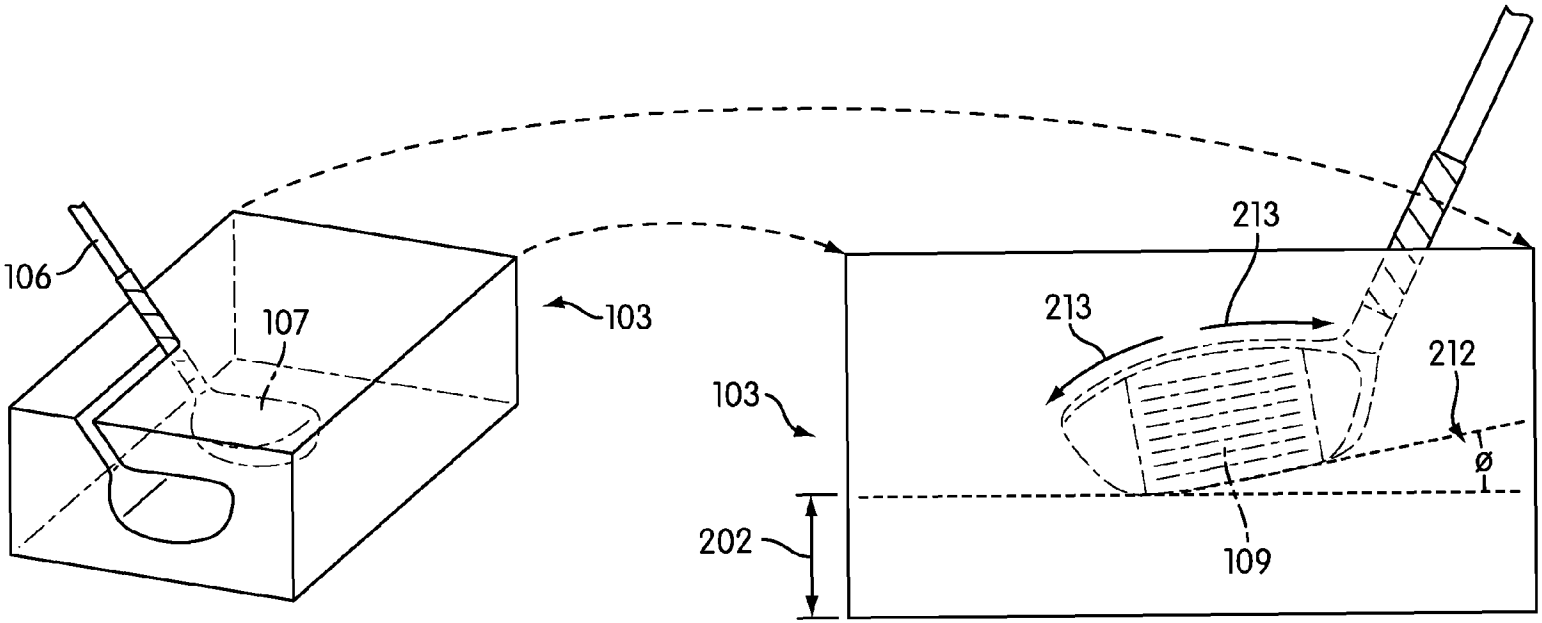
FIG. 6 shows a back view of the deformable medium of FIG. 1 after impact, and several various positions and angles of the golf club in the deformable medium.

Additionally, the method may be used to determine a value of the vertical angle of a club face. FIG. 6 shows a backside sectional view of the deformable medium 103. As shown in FIG. 6, the vertical angle of a club face 212 is the degree to which the club head 107 rotates as shown by arrows 213. The vertical angle of a club face 109 may affects the nature of the spin imparted to a golf ball during the swing.

Although several swing profile characteristics have discussed above, the method of the present disclosure is not limited to these specific swing profile characteristics. The method of the present disclosure may be used to determine various other swing profile characteristics, as may be desired by the golfer.

The deformable medium 103 may generally be made of any material that changes from a first configuration to a second configuration upon impact by the golf club. In some embodiments, the deformable medium 103 retains the second configuration 105 permanently. In such embodiments, the deformable medium undergoes a plastic deformation. The term "plastic deformation" is used in the materials sciences arts to refer to the deformation of a material undergoing non-reversible changes of shape in response to applied forces. As discussed above herein, such embodiments generally have a compressive strength such that the yield point on the stress-strain curve is within the range of forces that can be applied by a club head during a normal golf swing. Embodiments wherein the change from the first configuration to the second configuration are permanent are shown in FIGS. 1-15.

Examples of materials that may comprise the deformable medium 103 in such embodiments include a foam, clay, compacted sand or a plastic. Generally, the material should have a small range of stress over which the material experiences elastic (i.e. non-plastic) deformation, and a wide range of stress over which the material experiences plastic deformation before failure. Cellular foam materials, in particular, may be configured with a wide range of compressive strengths, such that the properties of the foam can be tailored to have a specific desired compressive strength for use in the present method.

Figure 16:
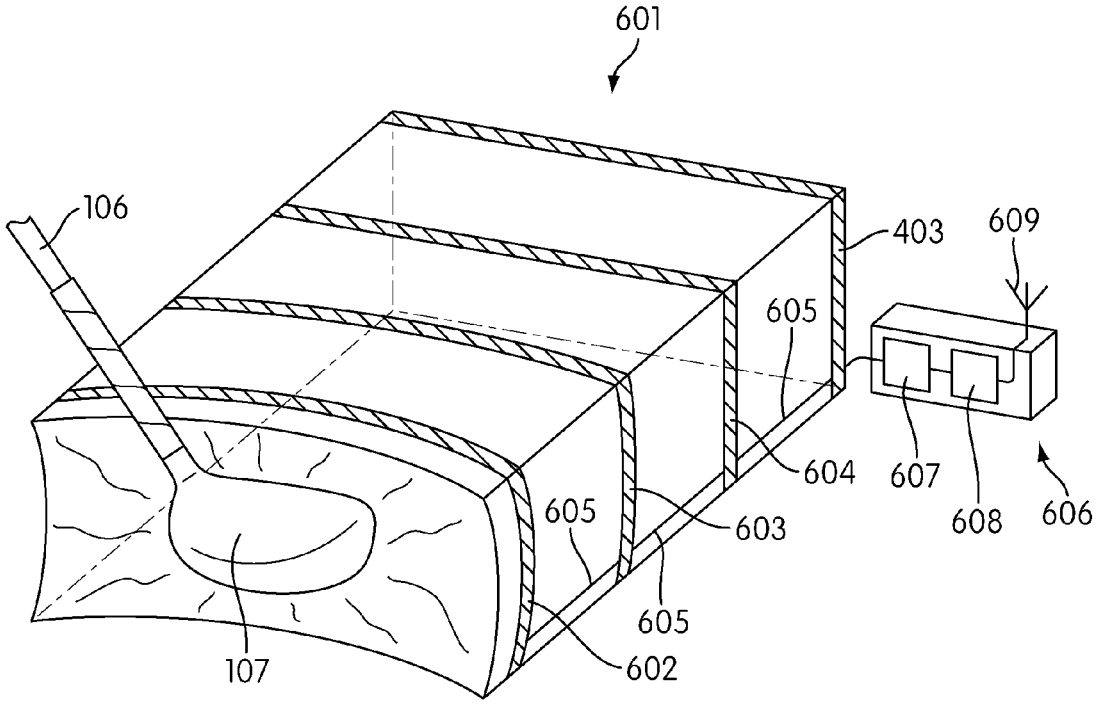
FIG. 16 shows another embodiment of the deformable medium, as it is impacted by the golf club.
Figure 17:
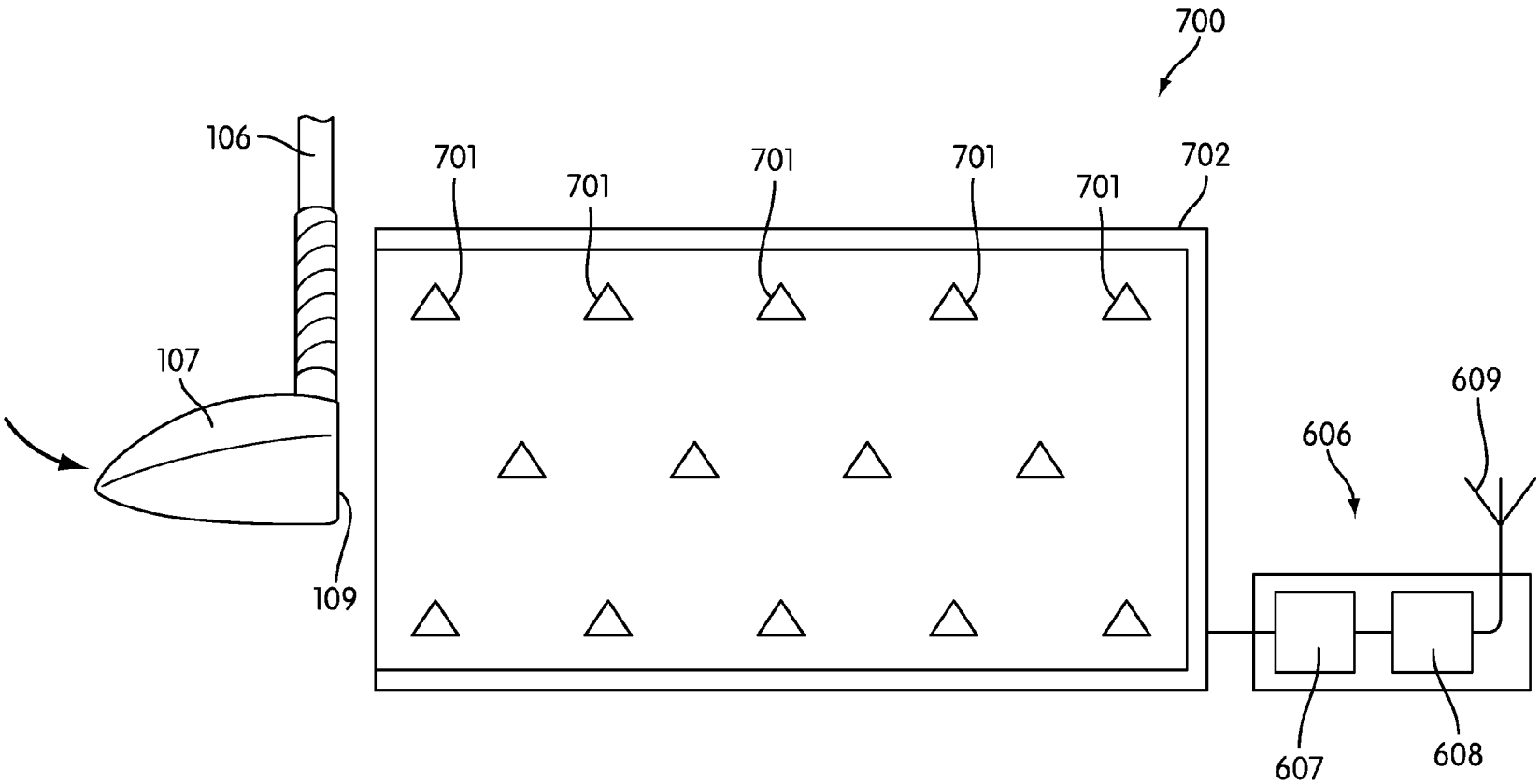
FIG. 17 shows a side sectional view of yet another embodiment of the deformable medium.
Figure 18:
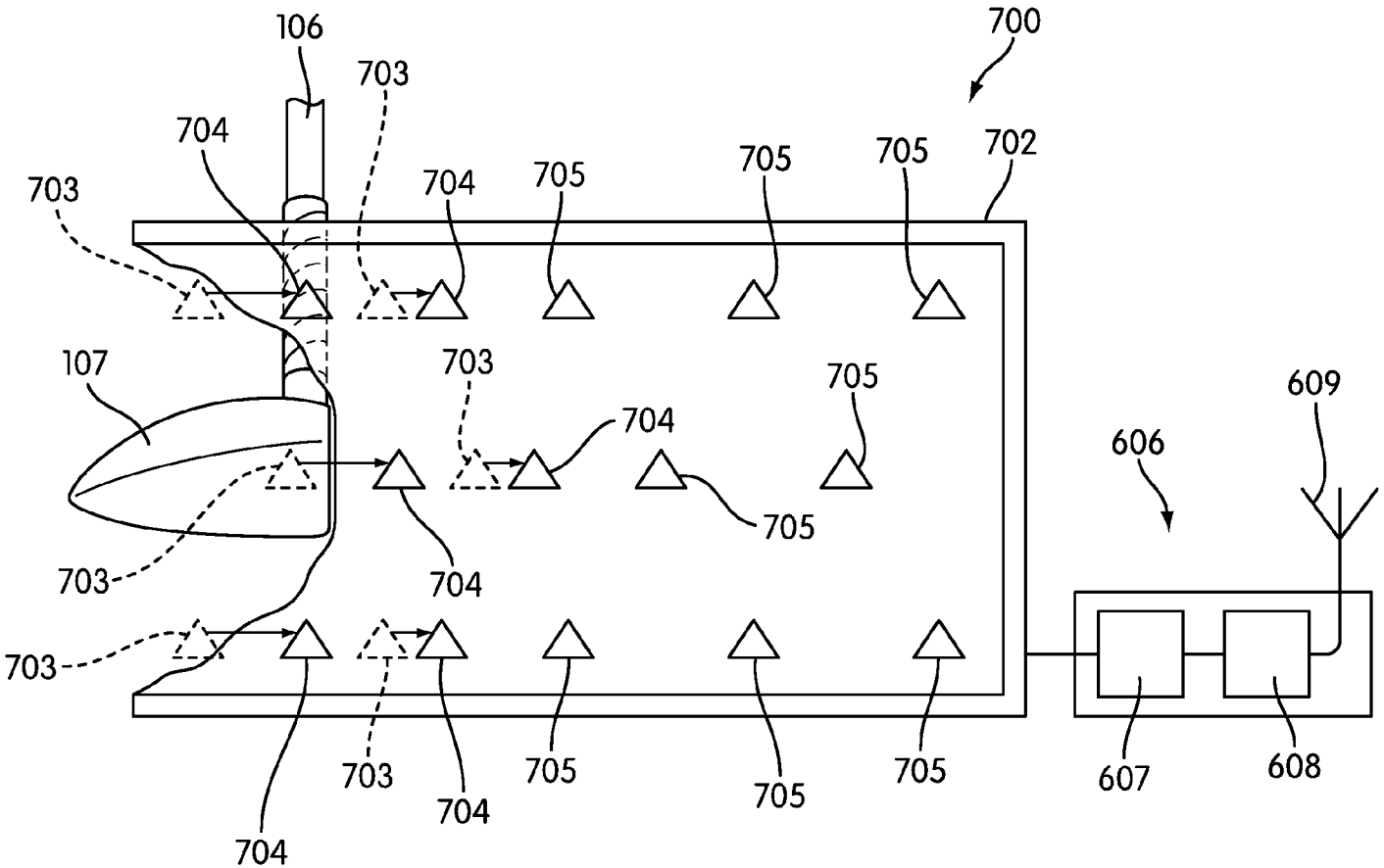
FIG. 18 shows a side sectional view of the deformable medium of FIG. 17, after impact by the golf club.

In other embodiments, the change from the first configuration to the second configuration is not permanent. In such embodiments, the deformable medium 103 returns to the first configuration in a predetermined time period after the impact. FIGS. 16-18 show such embodiments. The predetermined time period may be long or short. For example, a long predetermined time period may be on the order of several minutes to half an hour. A short predetermined time period may be on the order of small factions of a second. Generally, in these embodiments, the deformable medium undergoes deformation that is only elastic, and does not plastically deform.

Examples of materials that may be used in embodiments wherein the deformable medium 103 does not undergo permanent deformation include rubber, gels, and "memory" foams.

Figure 7:
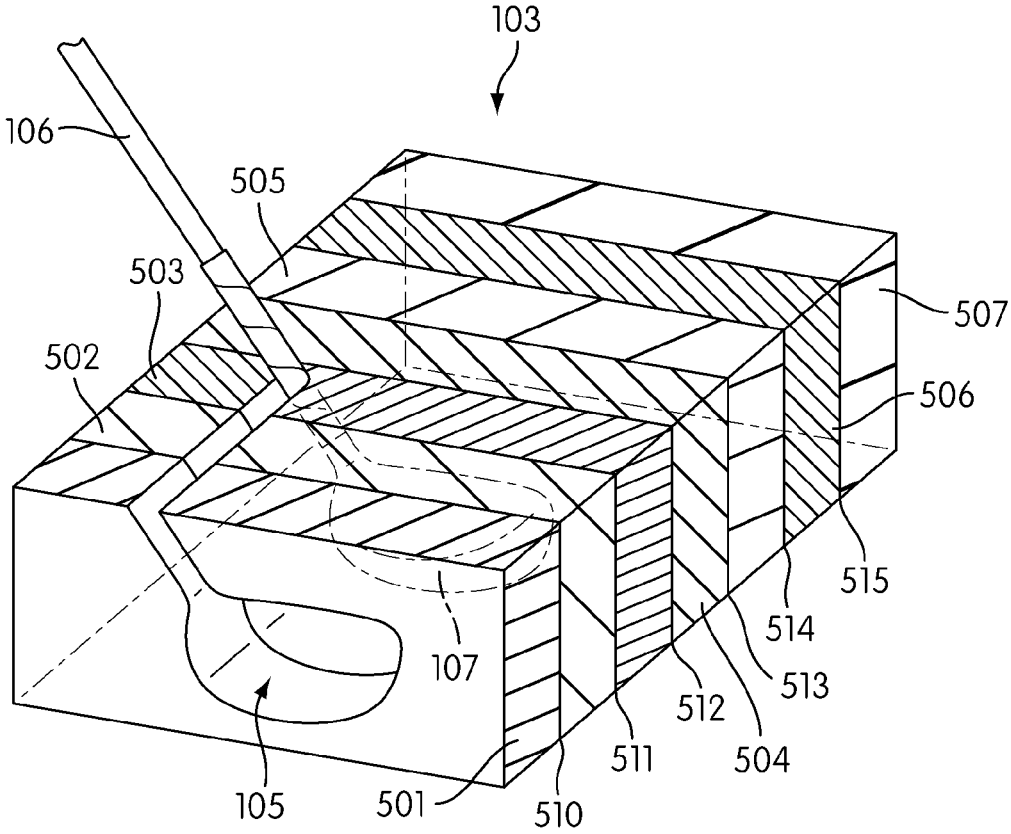
FIG. 7 shows an embodiment of the deformable medium, wherein the deformable medium is made up of a series of several contiguous vertical segments of deformable material.
Figure 8:
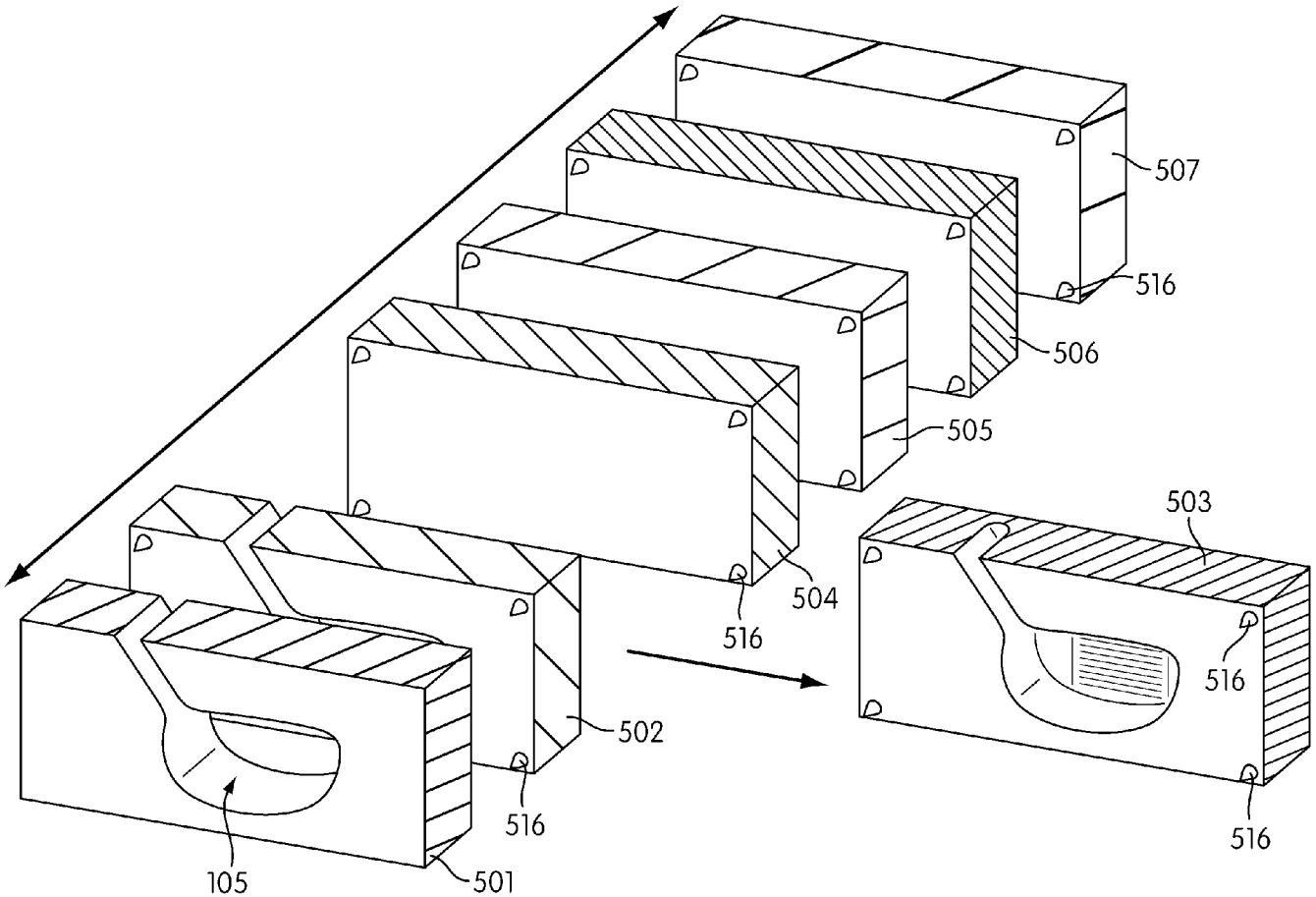
FIG. 8 shows an exploded view of the embodiment of the deformable medium of FIG. 7.

The deformable medium 103 may be arranged in a variety of forms. For example, FIG. 7 shows a particular embodiment of the deformable medium 103. This embodiment is made up of a series of at least two vertical segments of deformable material. In particular, the series of at least two vertical segments can be made up of a first vertical segment 501, a second vertical segment 502, a third vertical segment 503, a fourth vertical segment 504, a fifth vertical segment 505, a sixth vertical segment 506, and a seventh vertical segment 507. Although seven vertical segments are shown in FIGS. 7 and 8, the series of vertical segments can be made up of any number of vertical segments. For example, the series may comprise two vertical segments, three vertical segments, four vertical segments, or any number more. Generally, the thickness of each segment decreases as the total number of vertical segments in the series increases.

Each of the vertical segments in the series may be arranged perpendicularly to a surface over which the golf swing is conducted. In other words, the deformable medium 103 is positioned such that each vertical segment has a major axis perpendicular to the plane over which the golf swing is conducted.

Next, each vertical segment in the series may be marked so as to be visibly distinguishable from the other vertical segments. The marking may take the form of coloration, such as differing shades or different colors entirely. Alternatively, the marking may take the form of striations or other shading.

Each of the vertical segments in the series may have an interface, where it interfaces with an adjacent vertical segment. For example, first interface 510 may be located between the first segment 501 and the second segment 502, second interface 511 may be located between the second segment 502 and the third segment 503, third interface 512 may be located between the third segment 503 and the fourth segment 504, fourth interface 513 may be located between the fourth segment 504 and the fifth segment 505, fifth interface 514 may be located between the fifth segment 505 and the sixth segment 506, and sixth interface 515 may be located between the sixth segment 506 and the seventh segment 507.

As shown in FIG. 8, each of the vertical segments in the series may be separable from each other. Specifically, each interface may include an attachment mechanism 516. The embodiment of the attachment mechanism 516 shown in FIG.

8 is a pin type mechanism. However the attachment mechanism 516 may generally be any mechanism that keeps the vertical segments together during the method, such as a latch, a bolt, or chemical means such as an adhesive. The vertical segments may be separable so as to enable a golfer 101 to better inspect a particular segment, such as third segment 503, in order to measure the change in configuration 105 as a result of the impact of the golf club.

Figure 9:
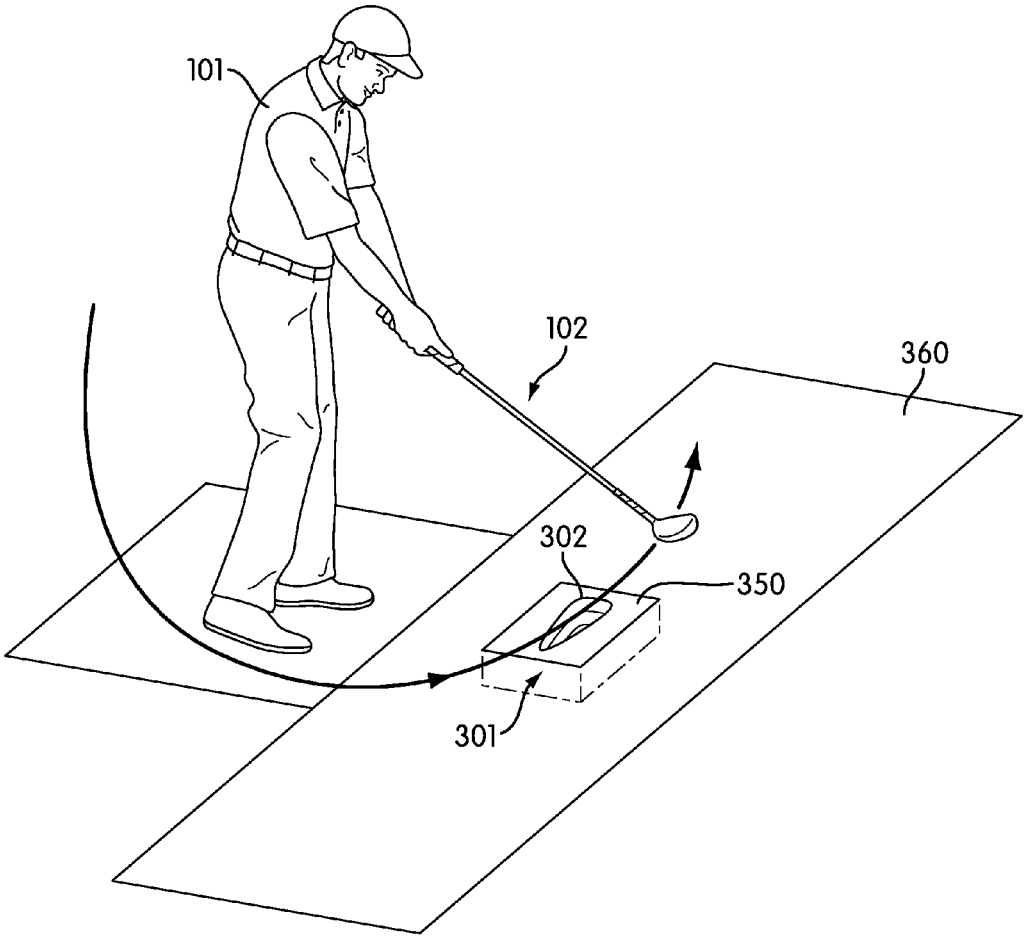
FIG. 9 shows a golfer swinging a golf club over another embodiment of a deformable medium.

The deformable medium may also take a different form 301, as shown in FIG. 9. FIG. 9 shows the golfer 101 performing a golf swing over the top surface 350 of deformable medium 301. In this embodiment, the deformable medium 301 has a top surface 350 that is flush was a surface 360 over which the golf swing is performed. The golf club 102 therefore causes the deformable medium 301 to change from a first configuration, such as a rectangular box (not shown), to a second configuration 302.

Figure 10:
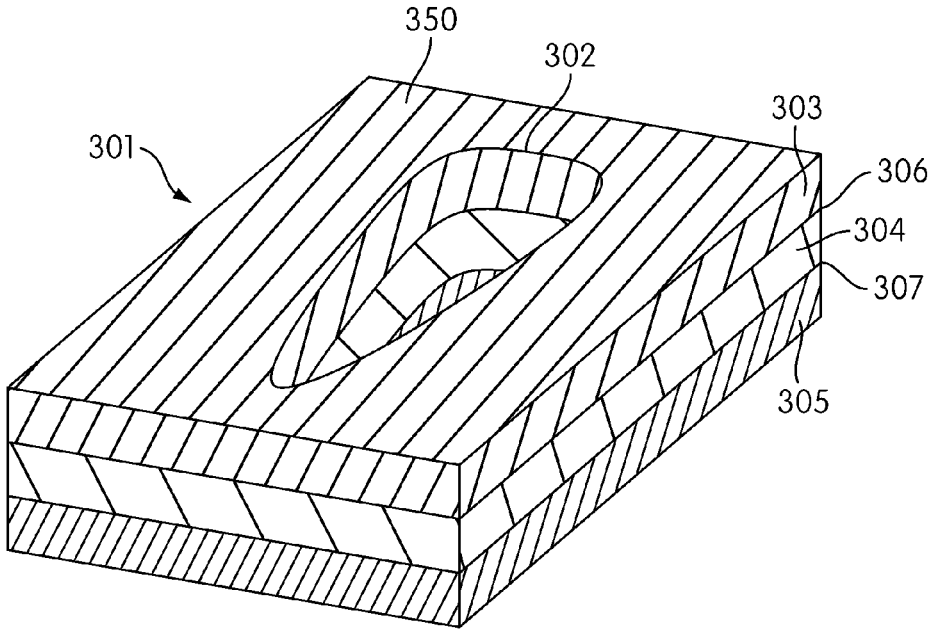
FIG. 10 shows a close-up view of an embodiment of the deformable medium of the type of deformable medium shown in FIG. 9.

FIG. 10 shows a particular embodiment of this type of deformable medium 301. Specifically, the deformable medium 301 may be made up of a series of at least two contiguous layers of deformable material. The deformable material 301 is positioned such that these layers are arranged parallel to the surface 360 over which the golf swing is conducted. Furthermore, each of the layers is marked so as to be visibly distinguishable from the other layers. These markings are as discussed above.

Figure 11:
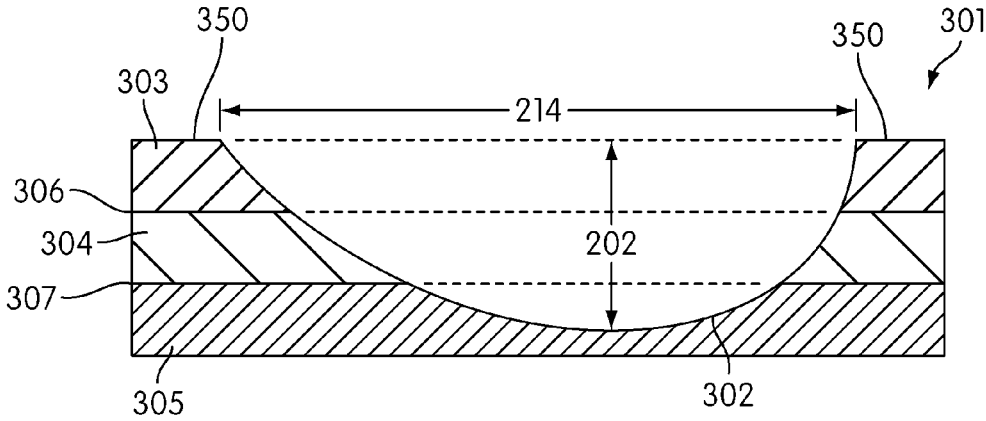
FIG. 11 shows a side view of the deformable medium of FIG. 10.

The particular embodiment shown in FIG. 10 includes three layers of deformable material in the series. Specifically, first layer 303 is a top layer, second layer 304 is an intermediate layer, and third layer 305 is a bottom layer. FIG. 11 shows a side sectional view of the embodiment of FIG. 10. FIG. 11 further shows the interfaces between each layer, such as first interface 306 between first layer 303 and second layer 304, and second interface 307 between second layer 304 and third layer 302. This embodiment also shows distance 202 as the vertical distance that correlates to the vertical position of the club face 209. Distance 214 is a horizontal distance that may correspond to distance 203, i.e., the distance 214 can correlate to the club head speed as discussed above.

Figure 12:
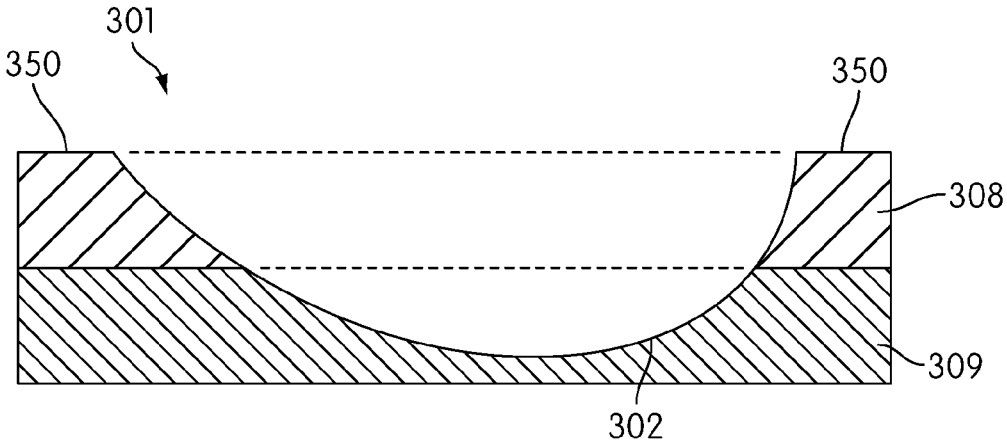
FIG. 12 shows a side view of another embodiment of the deformable medium of the type of deformable medium shown in FIG. 9.
Figure 13:
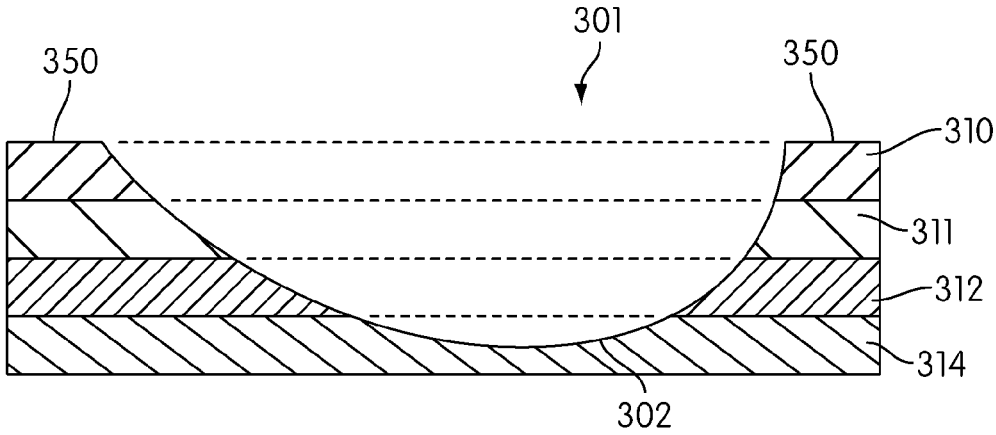
FIG. 13 shows a side view of another embodiment of the deformable medium of the type of deformable medium shown in FIG. 9.

FIGS. 12 and 13 show alternative embodiments of the deformable medium 301 that include different quantities of layers in the series. Specifically, FIG. 12 shows an embodiment of deformable medium 301 that is made up of a first layer 308 and a second layer 309. Similarly, FIG. 13 shows an embodiment of deformable medium 301 that is made up of a first layer 310, a second layer 311, a third layer 312, and a fourth layer 314.

The method may also use a different type of deformable medium, one that contains at least one sensor. This type of deformable medium is shown in FIGS. 14-18. In these embodiments of the method, the sensor measures the impact of the club head 107 so as to create a measurement, and then the measurement is correlated to a value of at least one swing profile characteristic.

Figure 14:
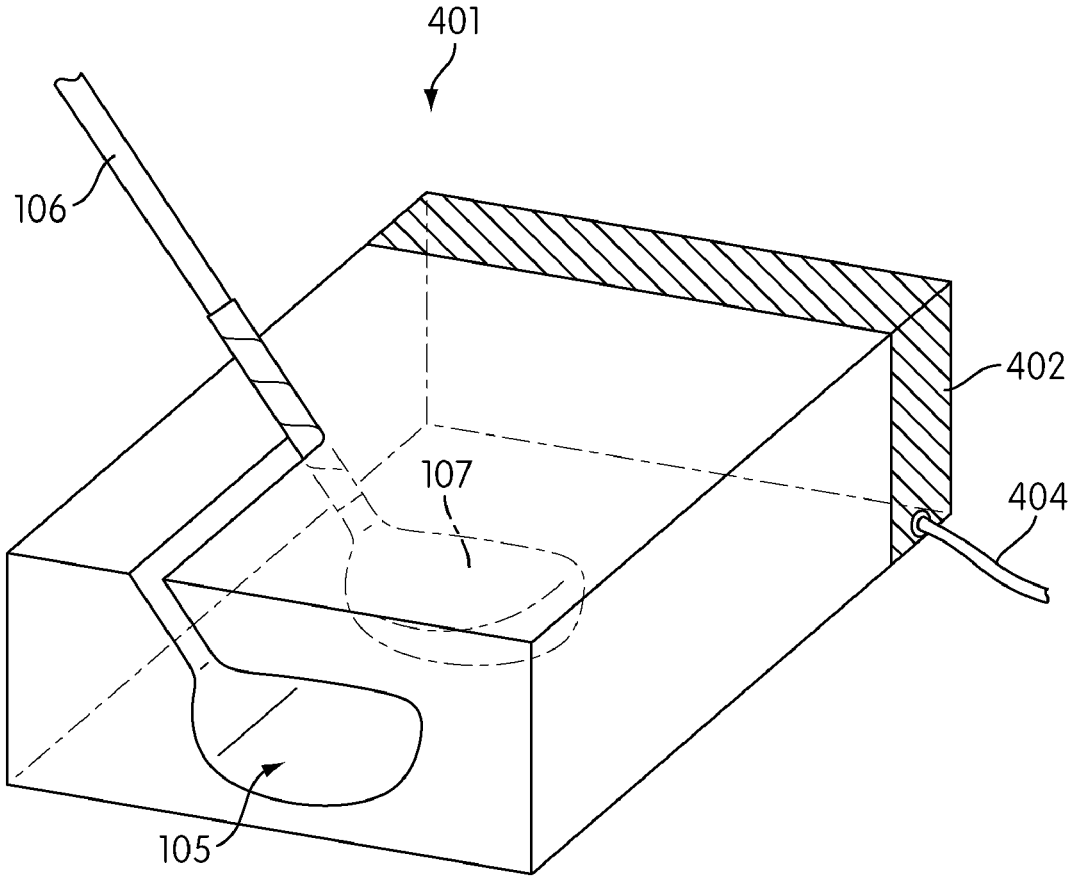
FIG. 14 shows a close up view of a different embodiment of the deformable medium.
Figure 15:
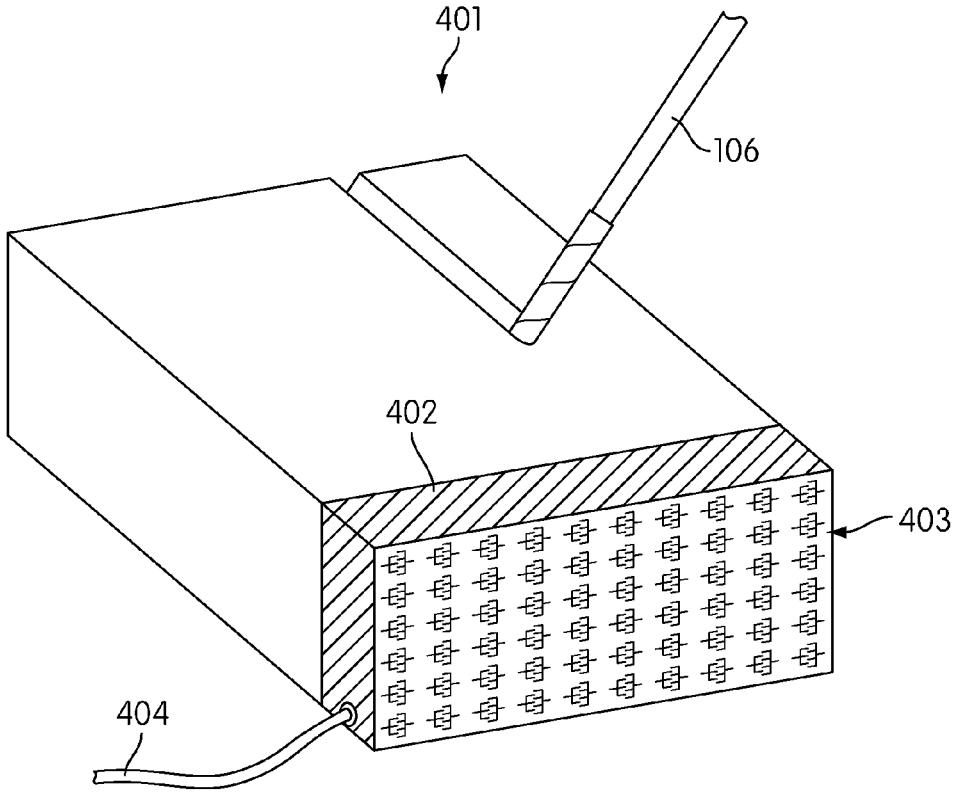
FIG. 15 shows the back side of the deformable medium of FIG. 14.

For example, in FIG. 14 the deformable medium 401 is impacted by the club head 107. The impact is measured by the sensor 402 so as to create a measurement. As shown in FIG. 15, the sensor 402 may be made up of multiple sensors in a two-dimensional pattern so as to constitute a sensor grid 403. The sensor grid exemplified in FIG. 15 is arranged perpendicularly to a surface over which the golf swing is conducted 360, however, the sensor grid may generally be at any angle within the deformable medium 401. Additionally, as shown in FIG. 15, the sensor grid may be located on a side of the deformable medium opposite the side of the deformable medium impacted by the club head 107. The sensor grid 403 may be connected to an external power source (not shown) and/or an external data destination (not shown) such as a general purpose computer by cable 404.

FIG. 16 shows an alternative embodiment using several sensor grids within the deformable medium. Specifically, FIG. 16 shows that a first sensor grid 602, a second sensor grid 603, a third sensor grid 604 may be present in addition to sensor grid 403 in a deformable medium 601. Although FIG. 16 shows four sensor grids, the deformable medium 601 may generally contain any number of at least several sensor grids. Just as with sensor grid 403, each of the several sensor grids may be arranged perpendicularly to a surface over which the golf swing is conducted 360. Furthermore, each of the sensor grids may be located at a different distance from a side of the deformable medium that is impacted by the club head. Therefore, the several sensor grids may better measure the impact of the club head 107, depending on the degree of force applied by the impact.

Generally, the single sensor grid 403 as shown in FIG. 14 or the several sensor grids as shown in FIG. 16 measure an impact of the club head 107 by measuring any of several variables that can be correlated to the value of a swing profile characteristic. Specifically, the sensor grid may measure a sensor location within the deformable medium, an impact location on the two dimensional sensor grid, a shape of the impact of the club head, and an amount of force created by the impact of the club head.

The several sensor grids may be connected by a wire 605, in order to transfer electric power or data information. The deformable medium 601 may also be connected to an electronic storage and transmission mechanism 606, as shown in FIG. 16. The electronic storage and transmission mechanism 606 may include a controller 607. The controller 607 may process measurement data captured by the sensor grids. The electronic storage and transmission mechanism 606 may also include a data storage mechanism 608, for storing the measurement data. Finally, the electronic storage and transmission mechanism may include an antenna 609 in order to wirelessly transmit the measurement data to, for example, a general purpose computer.

Although the several embodiments of the deformable medium 401 and 601 are discussed separately with respect to FIGS. 14-16, each of the features of these embodiments may be used interchangeably with any of the embodiments disclosed herein.

Another embodiment using sensors is shown in FIGS. 17 and 18. In this embodiment, the deformable medium 700 may include multiple sensors 701 that are separately located at different locations throughout the deformable medium 700. Although FIG. 17 shows a side sectional view, the sensors 701 are understood to have any three dimensional coordinates within the deformable medium 700. This embodiment may further include a housing 702 that surrounds the deformable medium therein. The housing may constitute a receiver, such that the three dimensional location of each sensor 701 is detected by the housing receiver 702.

When the deformable medium 700 is impacted by the club head 107 the change in position of at least some of the sensors 701 can be detected. Specifically, FIG. 18 shows how several of the sensors 701 may move from a first position 703 to a second position 704 due to the impact of the club head 107. Some of the sensors 705 may be left unmoved. Thus, the change in position from the first position 703 to the second position 704 may be a mechanism by which the sensors obtain a measurement of the impact.

The deformable medium 700 may further comprise the electronic storage and transmission mechanism 606, as discussed above.

Finally, the present disclosure provides the structures, apparatuses, and kits which may be used in accordance with the above discussed method.

The deformable medium used in the method has been extensively discussed above. Such a deformable medium may, in one embodiment have a predetermined compressive strength such that the medium will undergo plastic deformation when impact by a club head 107 so as to result in a deformation 105, as discussed above. The deformable medium may further include at least two contiguous sections of deformable medium, where the sections may be the vertical segments or the layers discussed above or other structures. Each of the sections may be marked so as to visibly distinguish each section from the others, as discussed above with respect to the vertical segments. Furthermore, each section may have a predetermined thickness.

These sections may be further configured such that a value of a golf swing profile can be determined from the deformation based on the predetermined thickness and the number of sections that are deformed. Several embodiments of deformable mediums having such an arrangement are shown in FIGS. 7, 8, and 10-13.

Additionally, the deformable medium discussed directly above may be provided in a kit along with a table. FIG. 19 shows a representative table that may be included in such a kit. Generally, the table displays at least one relationship between the predetermined thickness of each section deformed by the impact of the club head, the number of sections deformed, the value of a golf swing profile characteristic, and potentially any related attributes of the club head.

For example, as shown in FIG. 19, the table may display a relationship between the number of sections deformed, a club head weight (i.e. mass) and the value of a club head speed for a constant predetermined thickness of each section. Specifically, the table of FIG. 19 displays a relationship between deformation of a first section, a second section, and a third section, for various ranges of weights (i.e., masses) of the club head. However, the table included in the kit may displays any relationship among the several variables mentioned above.

The table may take the form of a printed table, a reference chart, a computer software package, a mobile computing platform, or any other information display system.

Accordingly, a golfer may purchase the kit, and then use the deformable medium to determine values of various swing profile characteristics by referencing the table. The golfer may thus improve his or her swing and thereby improve his or her game.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A method for analyzing a golf swing of a golfer swinging a golf club, the method comprising the steps of:

providing a deformable medium having a first configuration, the deformable medium having a known predetermined elasticity and a known predetermined compressive strength;

positioning the deformable medium in a path of the golf swing, such that at least a portion of a club head of the golf club will impact the deformable medium during the golf swing and cause the deformable medium to assume a second configuration, the second configuration being different from the first configuration;

obtaining a measurement that characterizes a change in shape between the first configuration and the second configuration; and correlating the measurement to a value of at least one swing profile characteristic.

2. The method according to claim 1, wherein the swing profile characteristic is at least one of: club head speed, angle of attack, angle by which a club face is open/closed, vertical angle of a club face or vertical position of club face.

3. The method according to claim 1, wherein the deformable medium retains the second configuration permanently.

4. The method according to claim 1, wherein the deformable medium returns to the first configuration in a predetermined time period after the impact.

5. The method according to claim 1, wherein the value of at least one swing profile characteristic is calculated from the measurement and a related attribute of the club head.

6. The method according to claim 1, wherein the deformable medium is adjacent to a perimeter of the club head on three sides upon impact.

7. The method according to claim 1, wherein the deformable medium comprises a series of at least two contiguous vertical segments of deformable material, the vertical segments being arranged perpendicularly to a surface over which the golf swing is conducted;

the vertical segments extending vertically upward from the surface over which the golf swing is conducted; and the vertical segments being marked such that each segment can be visibly distinguished from the others.

8. The method according to claim 1, wherein a top surface of the deformable medium is flush with a surface over which the golf swing is performed.

9. The method according to claim 8, wherein the deformable medium comprises a series of at least two contiguous layers of deformable material, the layers being arranged parallel to the surface over which the golf swing is conducted, and the layers being marked such that each layer can be visibly distinguished from the others.

10. The method according to claim 1, wherein the deformable medium comprises at least one of: a foam, clay, compacted sand or plastic.

* * * * *